US011619034B2

(12) United States Patent
Olson

(10) Patent No.: US 11,619,034 B2
(45) Date of Patent: Apr. 4, 2023

(54) FOLDABLE HYDRANT MARKER

(71) Applicant: Vandelay Products LLC, Lakeville, MN (US)

(72) Inventor: Jeffrey Olson, Lakeville, MN (US)

(73) Assignee: Vandelay Products LLC, Lakeville, MN (US)

( * ) Notice: Subject to any disclaimer, the term of this patent is extended or adjusted under 35 U.S.C. 154(b) by 0 days.

(21) Appl. No.: 17/656,161

(22) Filed: Mar. 23, 2022

(65) Prior Publication Data

US 2022/0307242 A1 Sep. 29, 2022

Related U.S. Application Data

(60) Provisional application No. 63/200,742, filed on Mar. 25, 2021.

(51) Int. Cl.
*E03B 9/04* (2006.01)

(52) U.S. Cl.
CPC ..... *E03B 9/04* (2013.01)

(58) Field of Classification Search
CPC ..... E03B 9/04
See application file for complete search history.

(56) References Cited

U.S. PATENT DOCUMENTS 2,167,579 A * 7/1939 Gardella ..... B60R 13/00 116/173
2,424,269 A * 7/1947 Doody ..... E03B 9/02 359/543
3,067,717 A * 12/1962 Imparato ..... G09F 17/00 116/63 P
4,908,249 A * 3/1990 Lines ..... E01F 9/608 40/607.1
7,694,641 B2 * 4/2010 Lockhart ..... E01F 9/608 40/607.1

OTHER PUBLICATIONS

Vandelay Products, LLC, E-Z Guide Products, Fire Hydrant Markers, published/available prior to the filing date, 2 pages.

* cited by examiner

*Primary Examiner* — Kevin R Barss
(74) *Attorney, Agent, or Firm* — Merchant & Gould P.C.

(57) ABSTRACT

A fire hydrant marker can include an indicator that signals the location of a fire hydrant when the fire hydrant is obstructed. In some examples, the indicator is attached to the fire hydrant by a base. The base allows the indicator to be pivoted between an indicating position and a folded position, thereby providing enhanced user access to the fire hydrant.

20 Claims, 19 Drawing Sheets

FOLDABLE HYDRANT MARKER

BACKGROUND

Fire hydrants are a primary source of water for batting a fire. It is important that the fire hydrants are easy to locate and access because it can take only a matter of minutes for a fire to engulf a structure. Hydrant markers are used to provide a visual indication of the location of the hydrants. For instance, snow, shrubs, vehicles, or other items can bury, obscure, or otherwise hide the location of a hydrant. A hydrant marker provides a higher vertical indicator so that the hydrant is easier to locate even if the hydrant is buried or otherwise obscured.

SUMMARY

This disclosure relates to an adjustable hydrant marker for fire hydrants. The example adjustable hydrant marker can generally include a base with an indicator rod that can be moved from an indicating position to a folded position.

According to one aspect of the disclosure, a fire hydrant marker is described. The fire hydrant marker includes an indicator rod extending to a free end. The fire hydrant marker further includes a base. The base comprises a mounting portion configured to be mounted to a fire hydrant, and a vertical portion extending from the mounting portion. The vertical portion is configured to hold the indicator rod in an indicating position and allow the indicator rod to be pivoted from the indicating position to a folded position. The indicator is further configured to remain in the folded position.

According to another aspect of the disclosure, a fire hydrant assembly is described. The fire hydrant assembly includes a fire hydrant and a fire hydrant marker. The fire hydrant marker includes an indicator rod extending to a free end. The fire hydrant marker further includes a base. The base comprises a mounting portion configured to be mounted to a fire hydrant, and a vertical portion extending from the mounting portion. The vertical portion is configured to hold the indicator rod in an indicating position and allow the indicator rod to be pivoted from the indicating position to a folded position. The indicator is further configured to remain in the folded position.

DETAILED DESCRIPTION

This disclosure is directed to hydrant markers for fire hydrants. In the examples provided herein, the hydrant markers include an indicating position in which the hydrant markers provide an indication of the location of the hydrants. The example hydrant markers also include a folded position in which the hydrant markers are moved to provide easier access to the hydrant.

Figure 1:
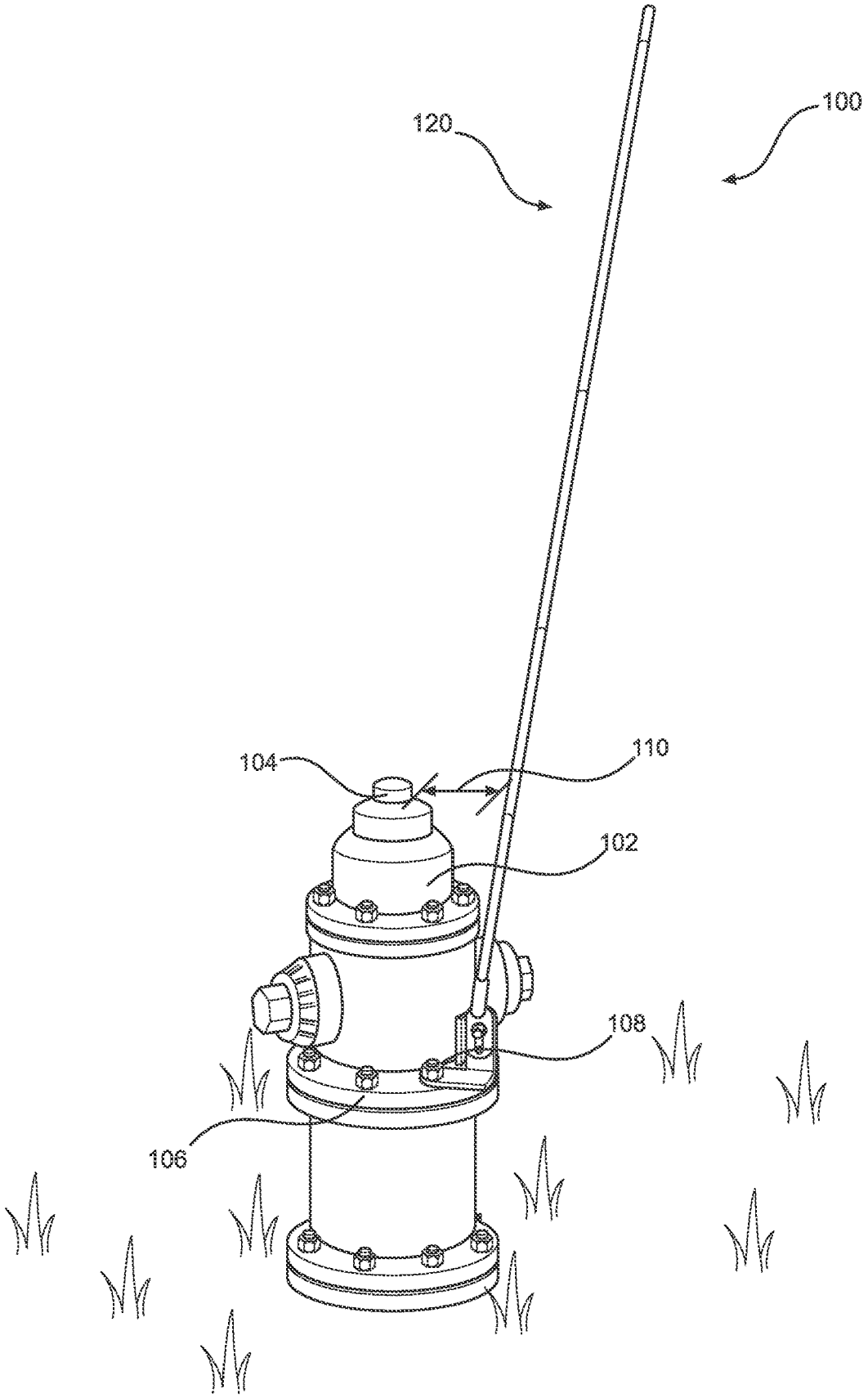
FIG. 1 is a perspective view of an example fire hydrant marker system in an indicating position.
Figure 2:
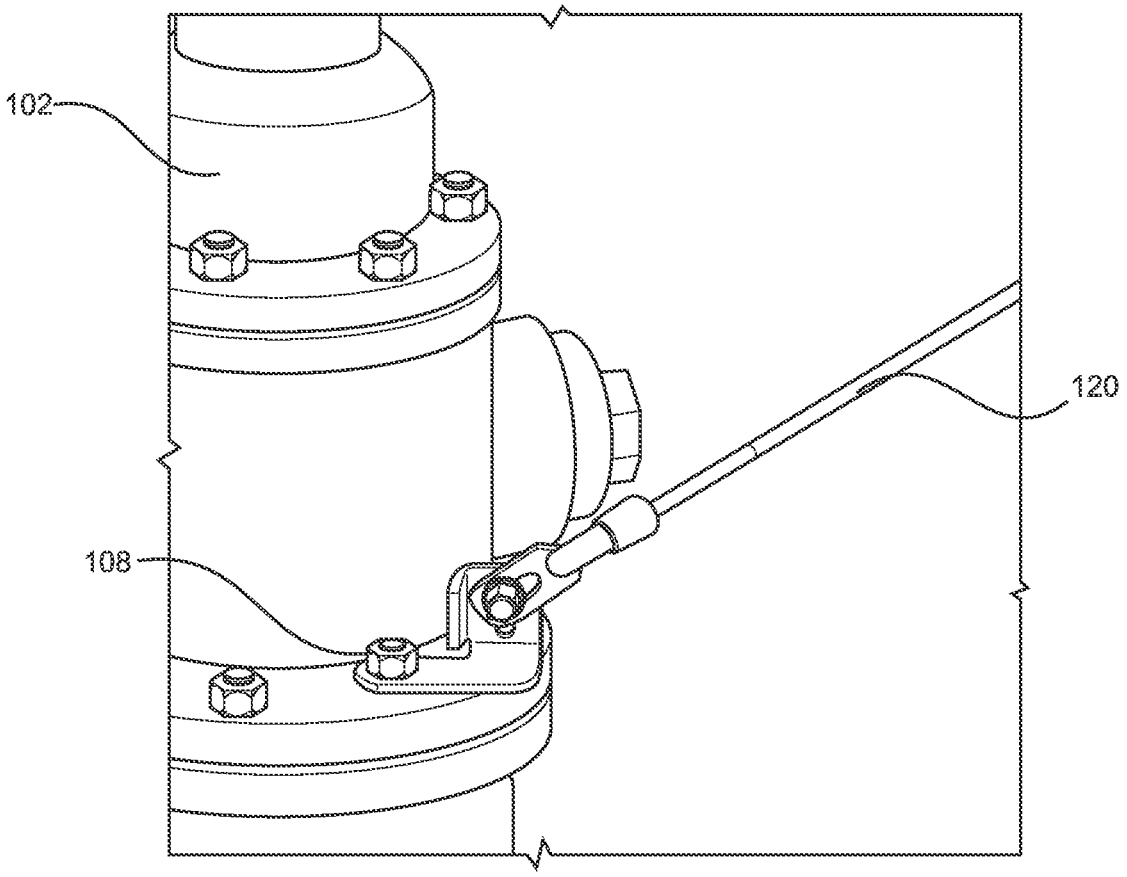
FIG. 2 is a perspective view of the example fire hydrant marker system of FIG. 1 in a partially folded position.
Figure 3:
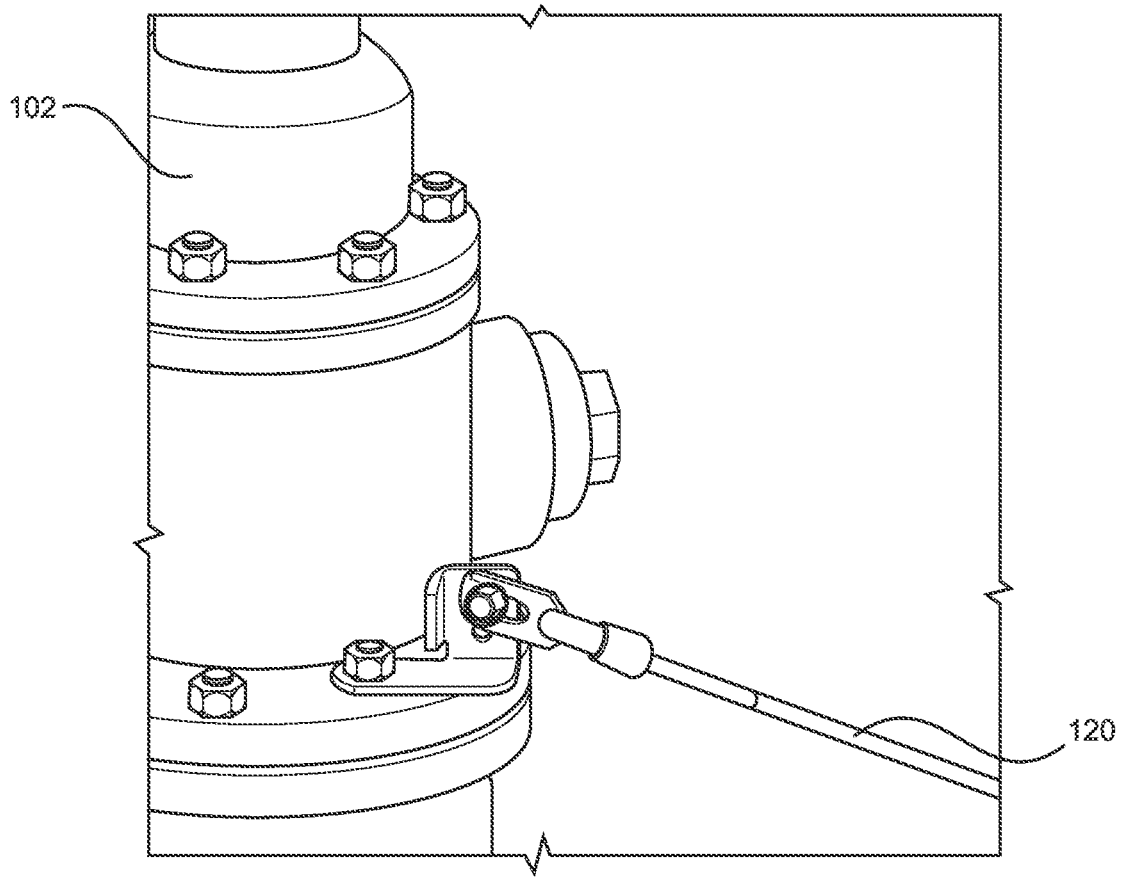
FIG. 3 is a perspective view of the example fire hydrant marker system of FIG. 1 in a fully folded position.
Figure 4:
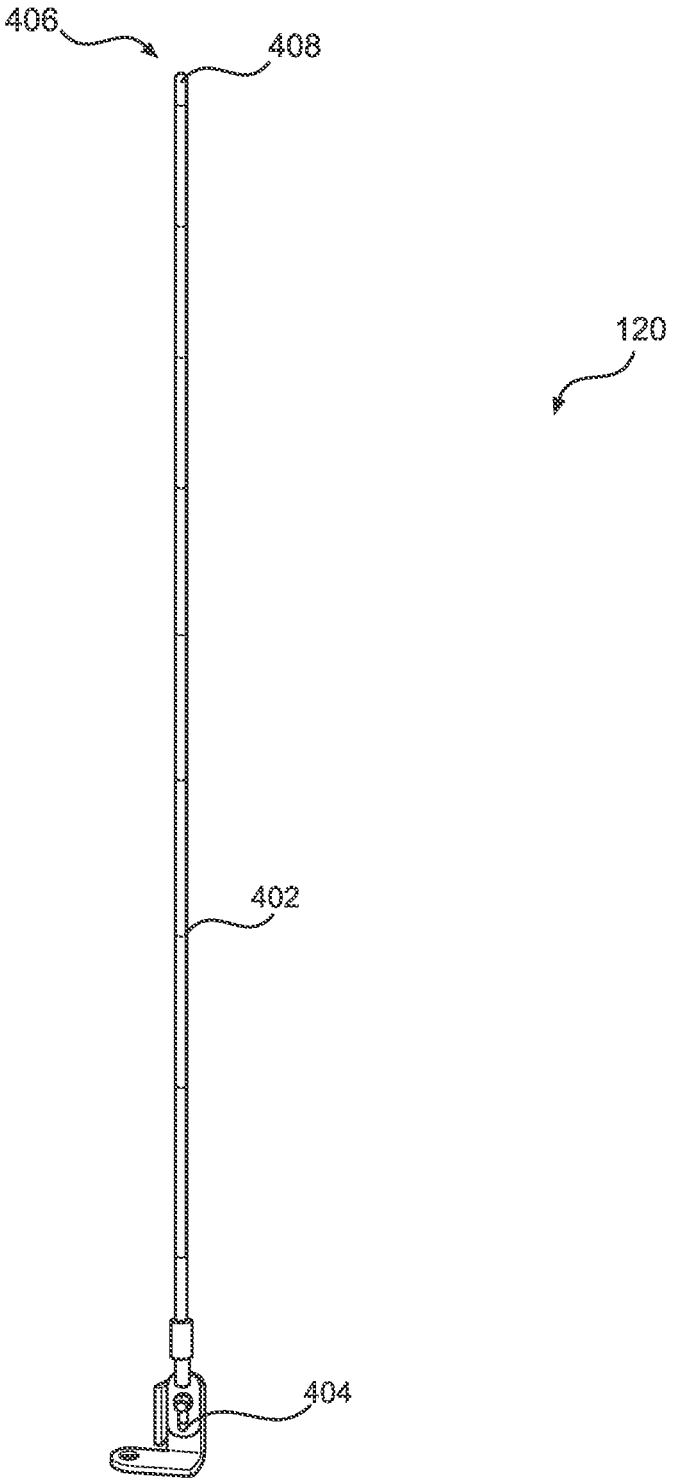
FIG. 4 is a front view of the example fire hydrant marker of the fire hydrant marker system of FIG. 1.

An example system 100 is shown in FIGS. 1-3. This system 100 includes a fire hydrant 102, in this instance of a dry barrel variety. The fire hydrant includes a stem nut 104 that is rotated to open and close a valve located underground to access water from the fire hydrant. Typically, a hydrant wrench having a significant length is used to allow the firefighter (or other user) to generate sufficient torque to turn the stem nut 104 to initiate water flow.

The example fire hydrant also includes a hydrant marker 120 to assist in locating the hydrant 102.

In this example, the hydrant marker 120 is affixed to the hydrant 102 by a bolt 108 running vertically through a flange 106 of the hydrant 102. Other configurations for affixing the hydrant marker 120 to the hydrant 102 are possible. For instance, in alternatives disclosed below, the hydrant marker 120 is affixed to the hydrant 102 in a different orientation.

The example hydrant marker 120 is shown in an indicating position in FIG. 1. In the indicating position, the hydrant marker 120 extends vertically to a higher position than the hydrant 102 to assist a firefighter in locating the hydrant 102 should it be buried (e.g., in snow) or otherwise obscured (e.g., by shrubs, vehicles, etc.).

Referring now to FIGS. 2-3, the hydrant marker 120 is foldable from the indicating position to a folded position. FIG. 2 depicts the hydrant marker 120 in a partially-folded position, and FIG. 3 depicts the hydrant marker 120 in a fully-folded position. Details on how the hydrant marker 120 is folded are described below.

An advantage of the hydrant marker 120 being foldable to the folded position is that access to the stem nut 104 is enhanced. For instance, a distance 110 between the stem nut 104 and the hydrant marker 120 may be smaller than the length of a hydrant wrench used to spin the stem nut 104 to access water from the hydrant 102. In such a scenario, the hydrant marker 120 must be displaced to allow the hydrant wrench to make each revolution.

The folded position of the hydrant marker 120 displaces the hydrant marker 120 to allow the firefighter to easily access the stem nut 104 without obstruction from the hydrant marker 120. In this folded position, the firefighter is provided "hands-free" access the stem nut 104 since the hydrant marker 120 remains in the folded position without input from the firefighter. Further, the process of moving the hydrant marker from the indicating position to the folded position requires no tools (e.g., is "tool-less").

Referring now to FIGS. 4-22, additional details of the example hydrant marker 120 are shown. The hydrant marker 120 includes an indicator rod 402 and a base 404. The base 404 allows the indicator rod 402 to be moved from the indicating position to the folded position.

In this example, the rod 402 is made of fiberglass or aluminum. In some examples, the rod is ⅜ inch solid pultrusion fiberglass or ⅜ inch mil spec zinc-plated carbon steel. Many other materials can be used.

A free end 406 of the rod 402 is capped with a rubber protective tip 408. The rod 402 can include a reflective surface to enhance visibility, such as reflective tape like 3M Engineer Grade Reflective Sheeting from 3M. For instance, the rod can include at least eight 6 inch-wide alternating strips of reflective tape, like 3M Engineer Grade Reflective Sheeting 3272 Red and 3290 White. The rod can be coated with an ultraviolet inhibitor, such as SunGuard II, to protect it from sun damage.

The example base 404 includes a mounting piece 504 with an opening 506 that allows the base 404 to be coupled to the hydrant 102 by the bolt 108 extending through the flange 106, as described previously. A vertical member 508 extends generally perpendicularly from the mounting piece 504. The vertical member 508 includes a fastener 530 and an opening 510, as described further below. Finally, a stopping member 502 extends generally perpendicularly from the vertical member 508.

Figure 18:
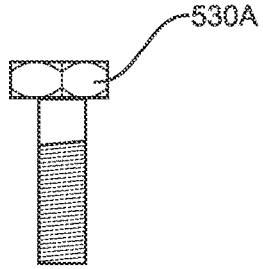
FIG. 18 is a side view of an example bolt of the hydrant marker system of FIG. 1.
Figure 19:
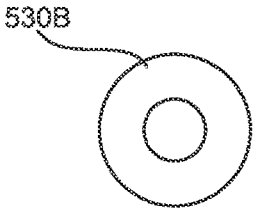
FIG. 19 is a side view of an example washer fastener of the hydrant marker system of FIG. 1.
Figure 21A:
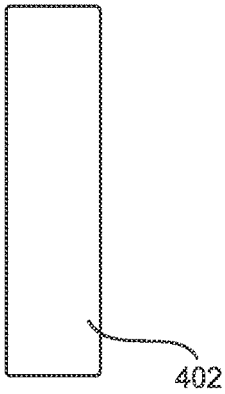
FIG. 21A is a side view of a section of an example rod of the hydrant marker system of FIG. 1.
Figure 17A:
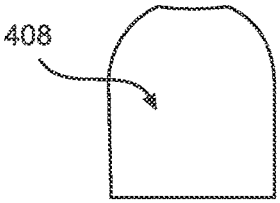
FIG. 17A is a front view of an example rubber protective tip of the indicator rod of the example hydrant marker system of FIG. 1.
Figure 20:
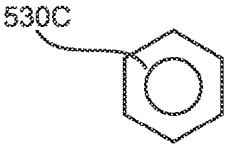
FIG. 20 is a side view of an example nut fastener of the hydrant marker system of FIG. 1.
Figure 17B:
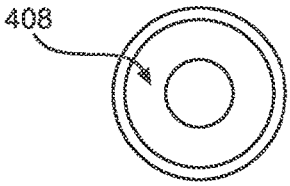
FIG. 17B is a bottom view of an example rubber protective tip of the indicator rod of the example hydrant marker system of FIG. 1.
Figure 21B:
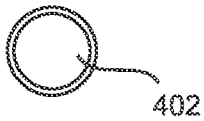
FIG. 21B is a cross-sectional view of an example rod of the hydrant marker system of FIG. 1.
Figure 22A:
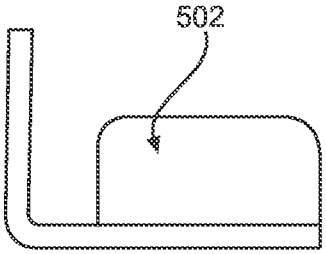
FIG. 22A is a right-side view of the base of the hydrant marker of the example fire hydrant marker system of FIG. 1.
Figure 22D:
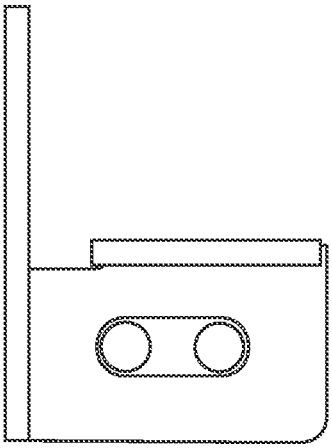
FIG. 22D is a front view of the base of the hydrant marker of the example fire hydrant marker system of FIG. 1.
Figure 22B:
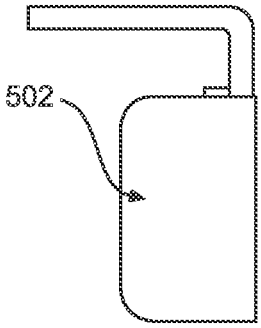
FIG. 22B is a left-side view of the base of the hydrant marker of the example fire hydrant marker system of FIG. 1.
Figure 22E:
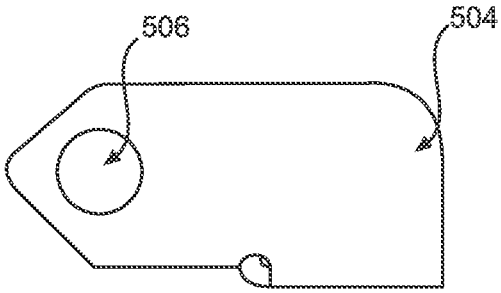
FIG. 22E is a bottom view of the base of the hydrant marker of the example fire hydrant marker system of FIG. 1.
Figure 22C:
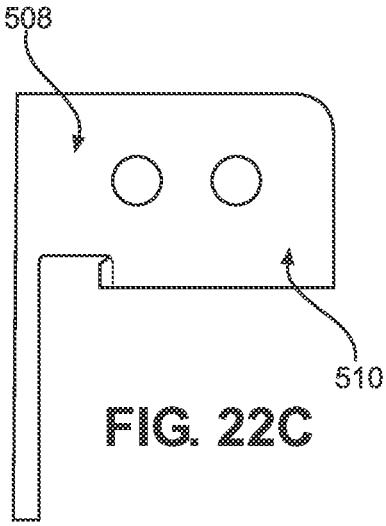
FIG. 22C is a rear view of the base of the hydrant marker of the example fire hydrant marker system of FIG. 1.

A base 520 is affixed to the indicator rod 402 of the hydrant marker 120. The base 520 includes an elongated opening 522 through which the fastener 530 extends to movably couple the base 520 to the vertical member 508 of the base 404. In some examples, as depicted in FIGS. 18-20, the fastener 530 includes a bolt 530A, a washer 530B, and a nut 530C.

Figure 5:
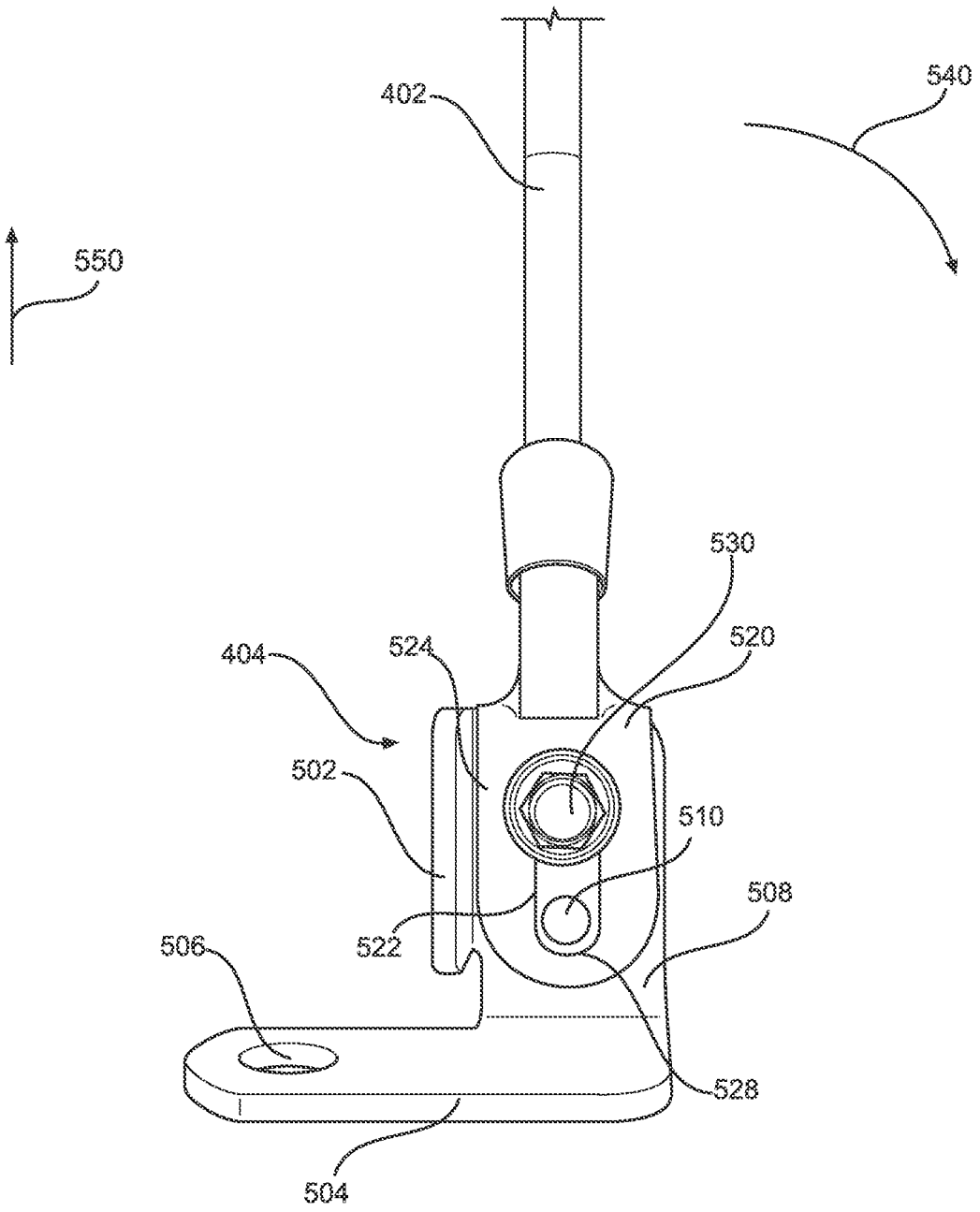
FIG. 5 is a front view of the base and indicator rod of the hydrant marker of the example fire hydrant marker system of FIG. 1 in the indicating position.
Figure 6:
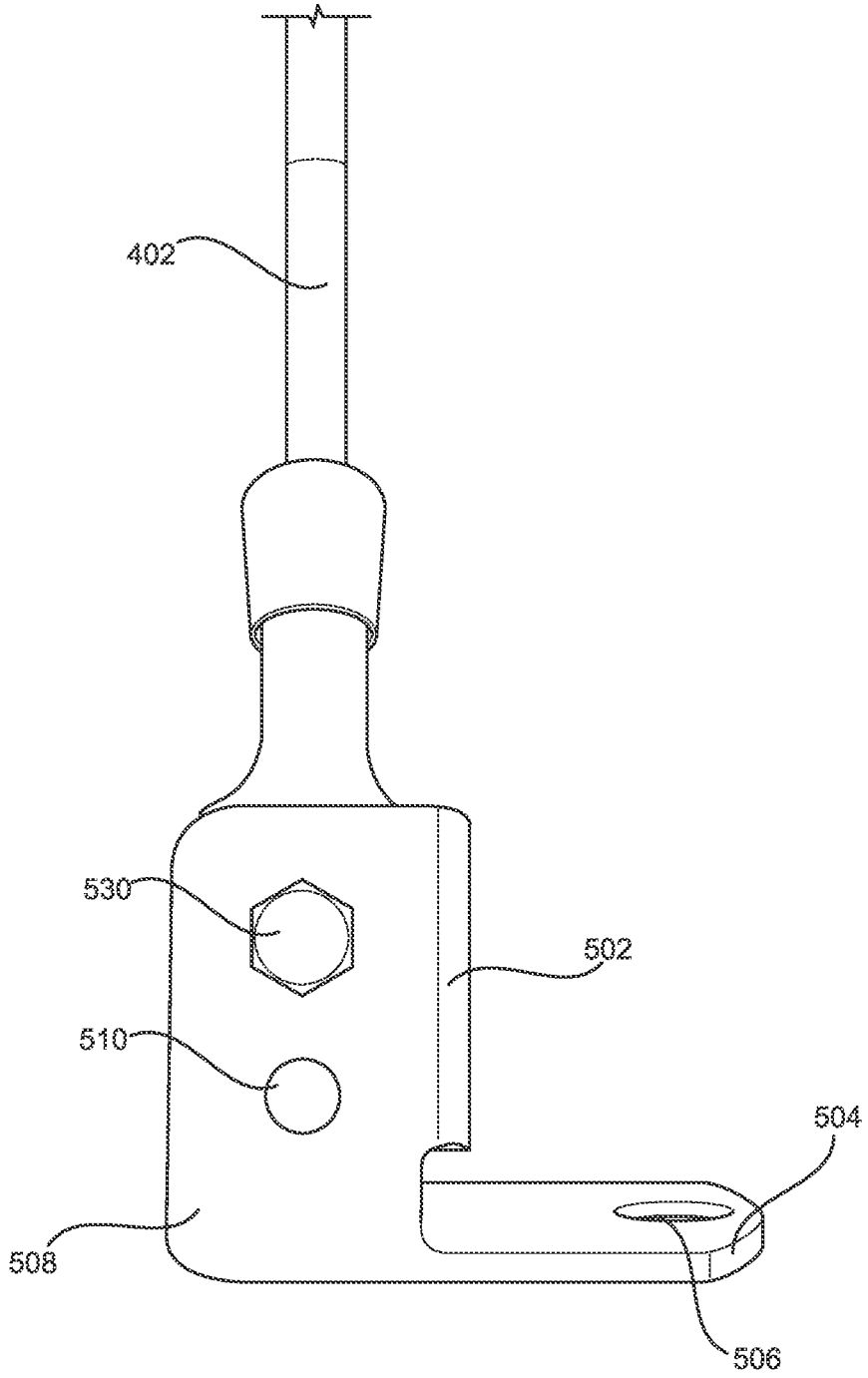
FIG. 6 is a rear view of the base and indicator rod of the hydrant marker of the example fire hydrant marker system of FIG. 1 in the indicating position.

In the position shown in FIGS. 5-6, the hydrant marker 120 is in the indicating position with the indicator rod 402 extending generally vertically upward. The indicator rod 402 is maintained in this position by a flat surface 524 of the base 520 generally contacting the stopping member 502 to thereby resist pivoting of the hydrant marker 120 in a direction 540 towards the folded position.

Figure 7:
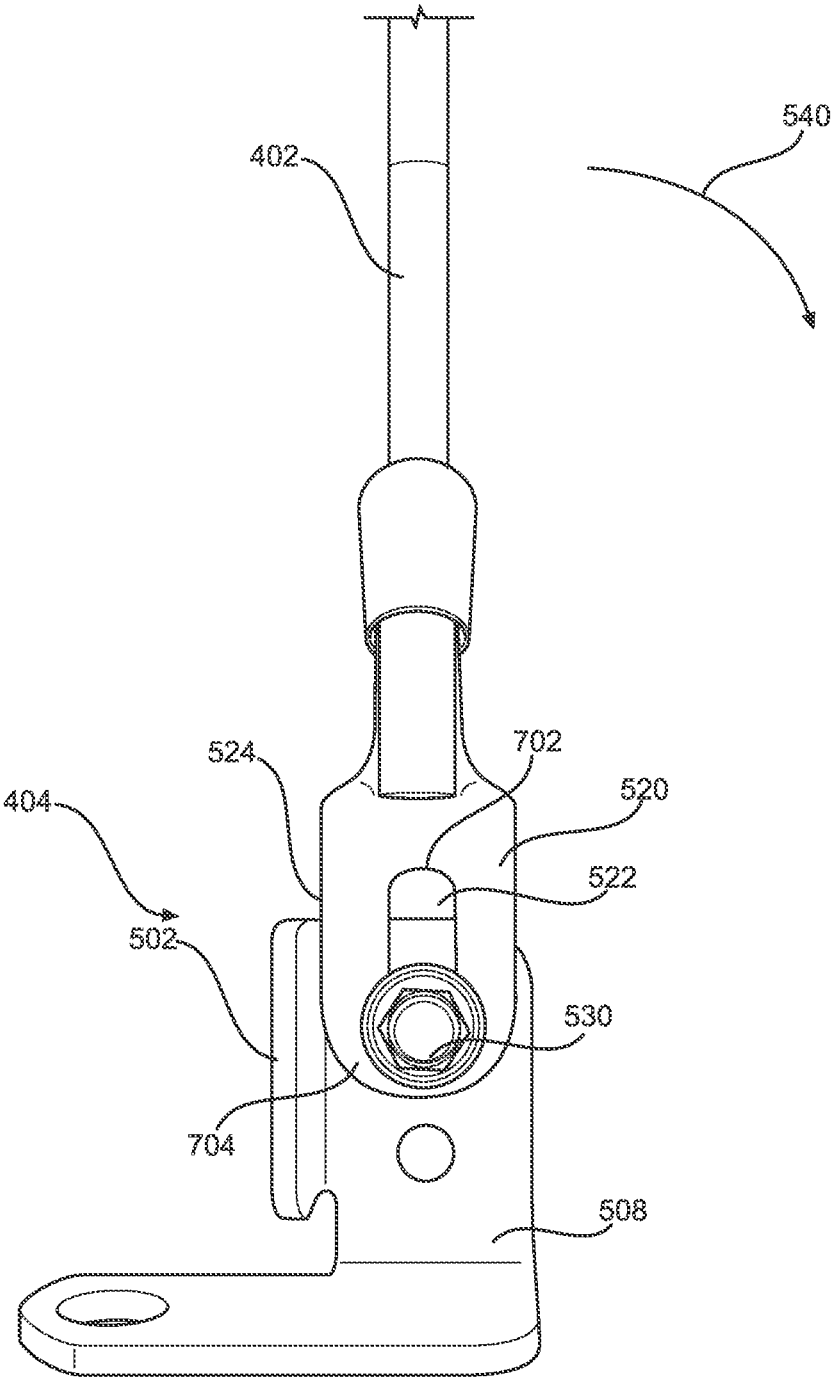
FIG. 7 is a front view of the base and indicator rod of the hydrant marker of the example fire hydrant marker system of FIG. 1 in a vertically raised position.
Figure 8:
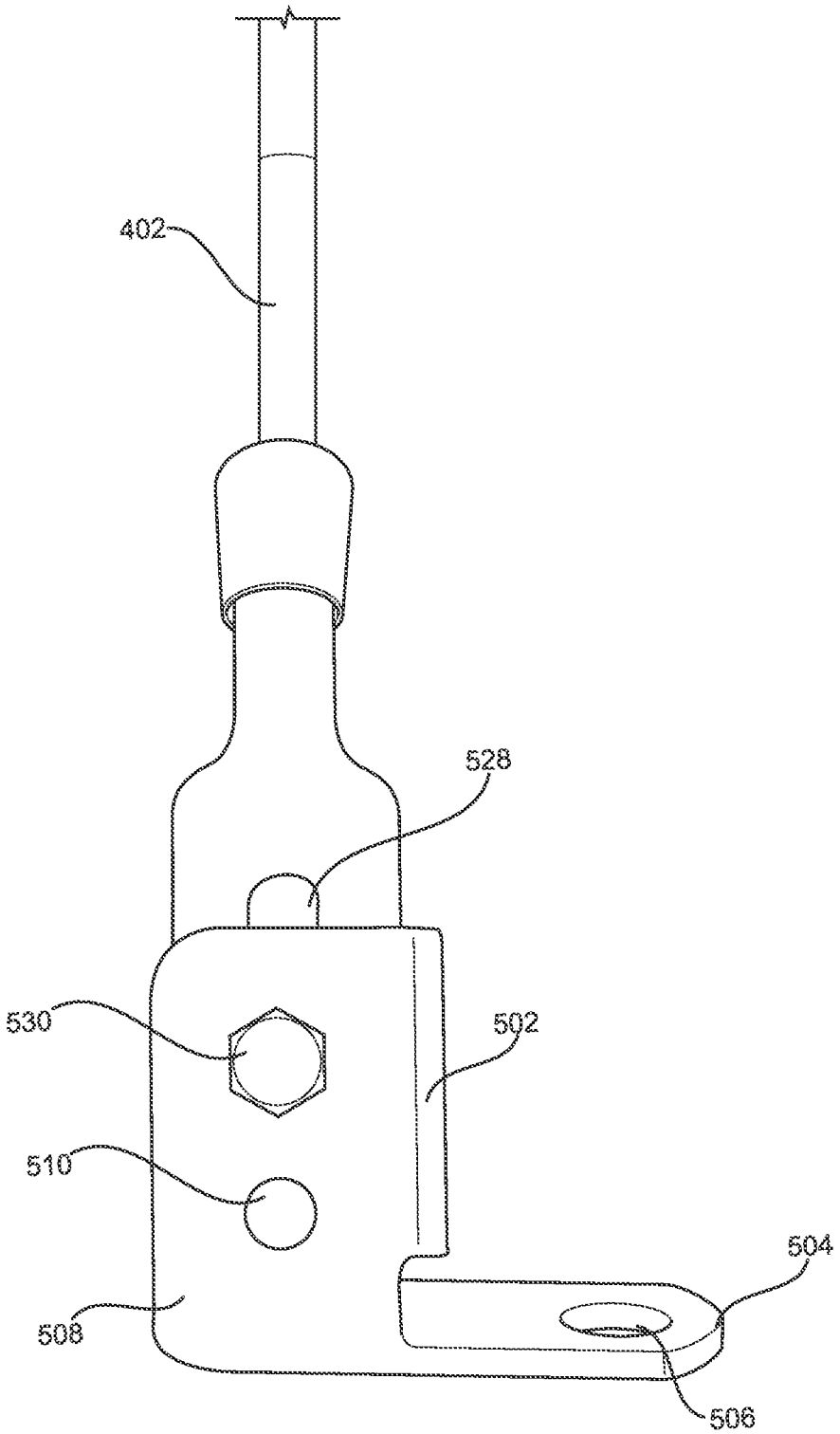
FIG. 8 is a rear view of the base and indicator rod of the hydrant marker of the example fire hydrant marker system of FIG. 1 in the vertically raised position.

In the position shown in FIGS. 7-8, the hydrant marker 120 is moved vertically in a direction 550 away from the mounting piece 504. When this occurs, the fastener 530 slides within the elongated opening 522 until the fastener 530 reaches a lower portion 528 of the opening 522 that is opposite to an upper portion 702. In this configuration, enough of the flat surface 524 clears the stopping member 502 to allow the hydrant marker 120 to be pivoted in the direction 540 towards the folded position.

Figure 9:
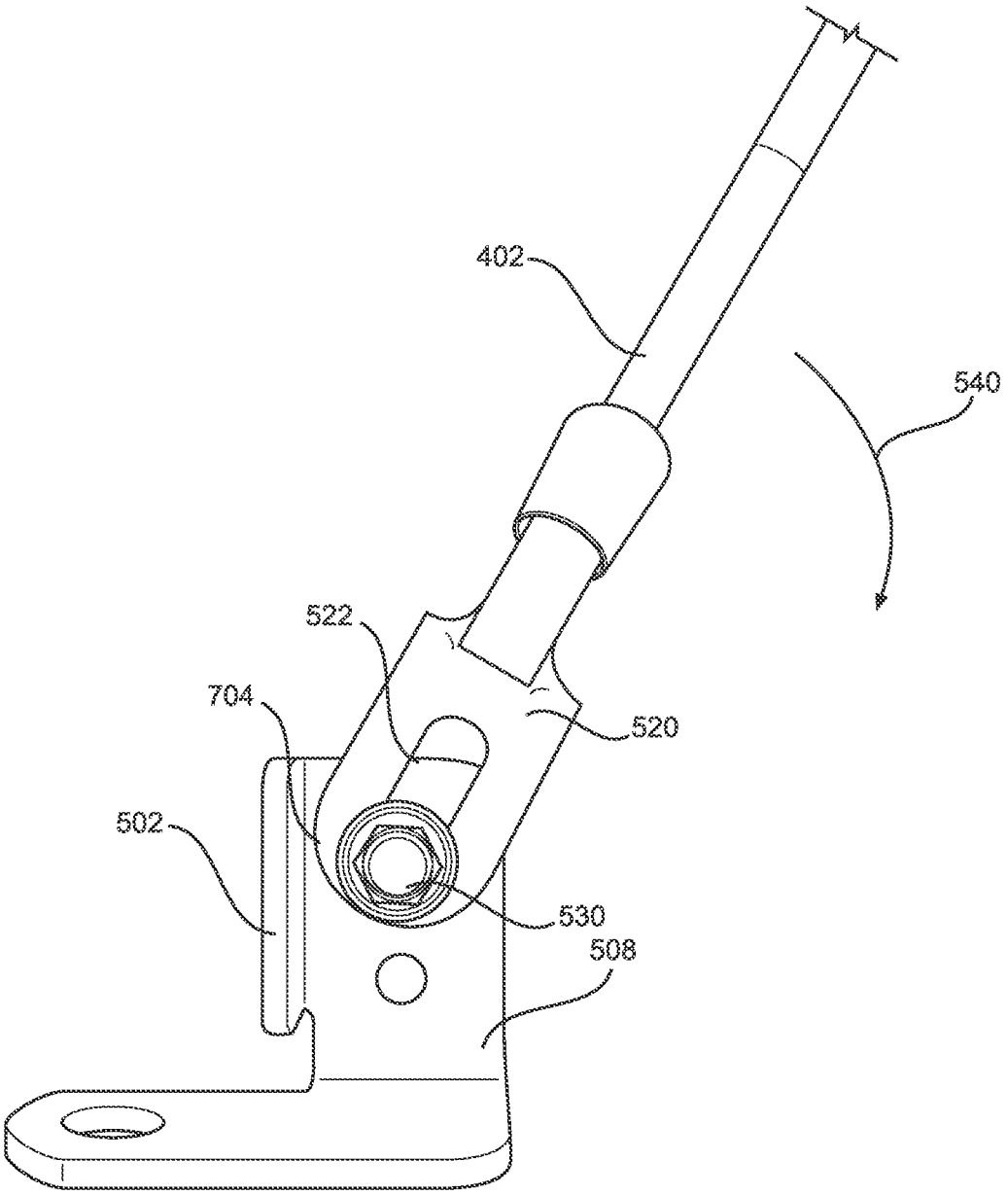
FIG. 9 is a front view of the base and indicator rod of the hydrant marker of the example fire hydrant marker system of FIG. 1 in the partially folded position.
Figure 10:
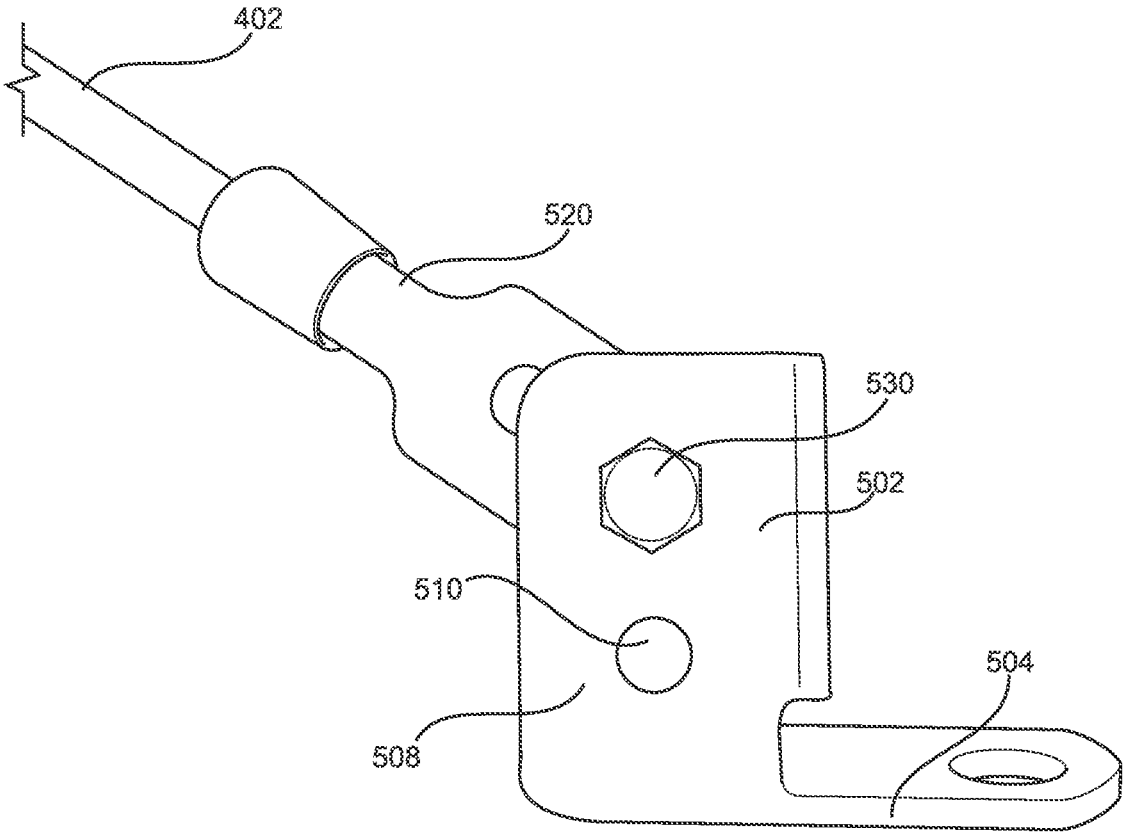
FIG. 10 is a rear view of the base and indicator rod of the hydrant marker of the example fire hydrant marker system of FIG. 1 in the partially folded position.

In the position shown in FIGS. 9-10, the hydrant marker 120 is pivoted in the direction 540 about the fastener 530 towards the folded position. A curved portion 704 of the base 520 allows the base 520 to clear the stopping member 502 during pivoting.

Figure 11:
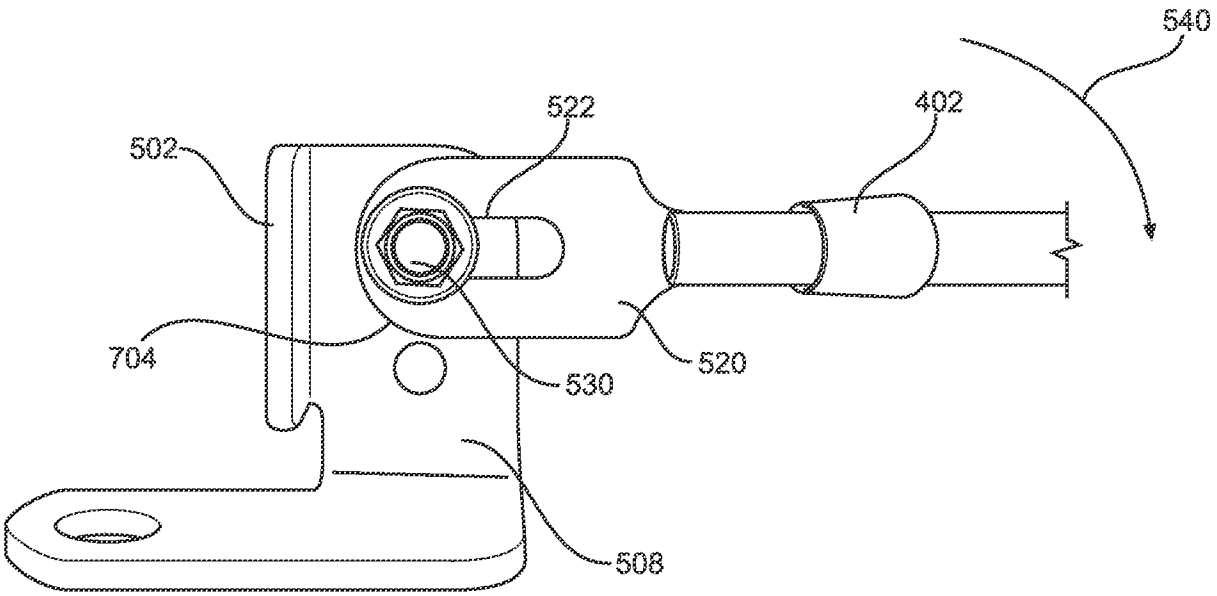
FIG. 11 is a front view of the base and indicator rod of the hydrant marker of the example fire hydrant marker system of FIG. 1 in the fully folded position.
Figure 12:
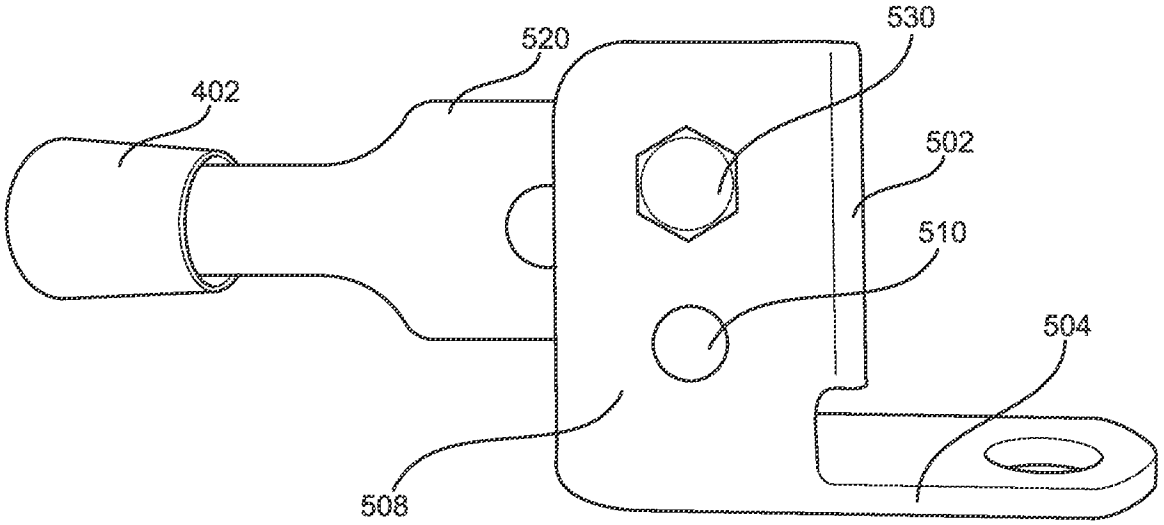
FIG. 12 is a rear view of the base and indicator rod of the hydrant marker of the example fire hydrant marker system of FIG. 1 in the fully folded position.
Figure 13:
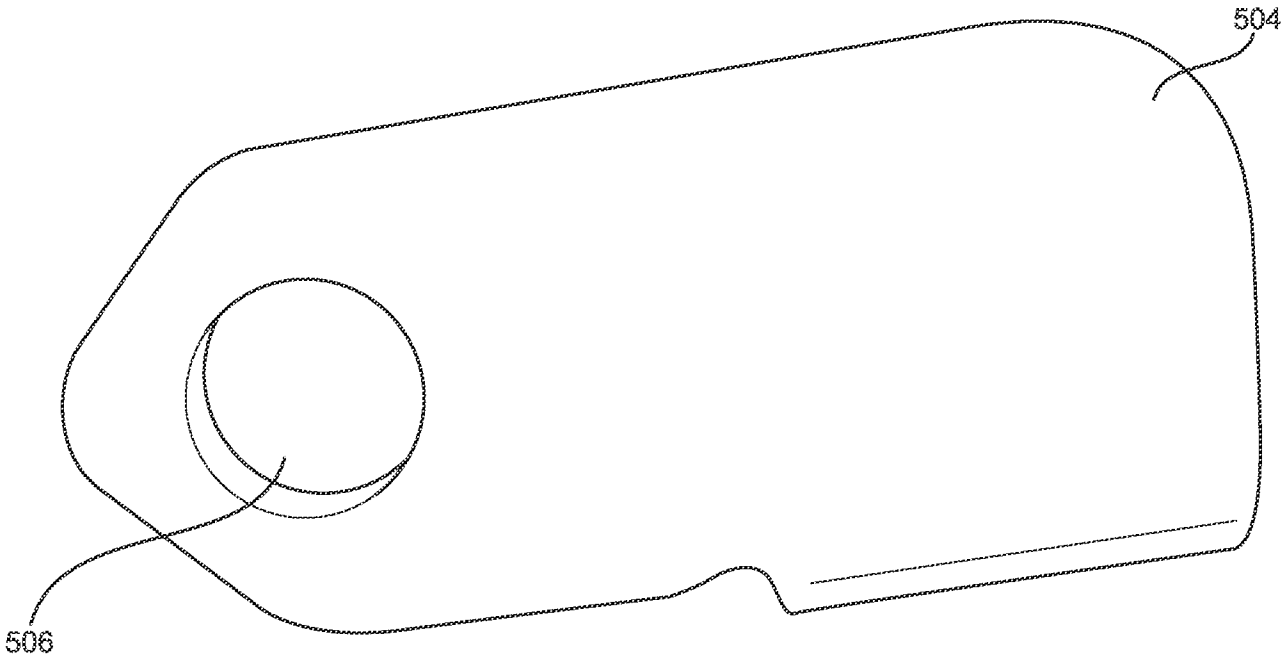
FIG. 13 is a bottom view of the base and indicator rod of the hydrant marker of the example fire hydrant marker system of FIG. 1.
Figure 14:
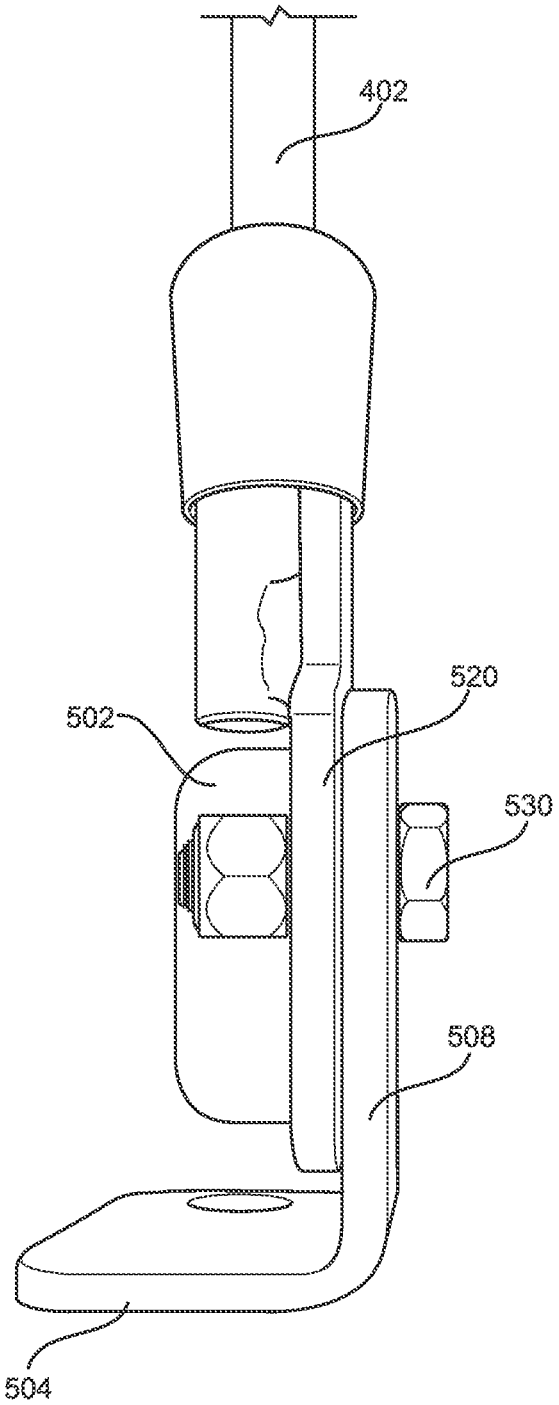
FIG. 14 is a right-side view of the base and indicator rod of the hydrant marker of the example fire hydrant marker system of FIG. 1 in the indicating position.
Figure 15:
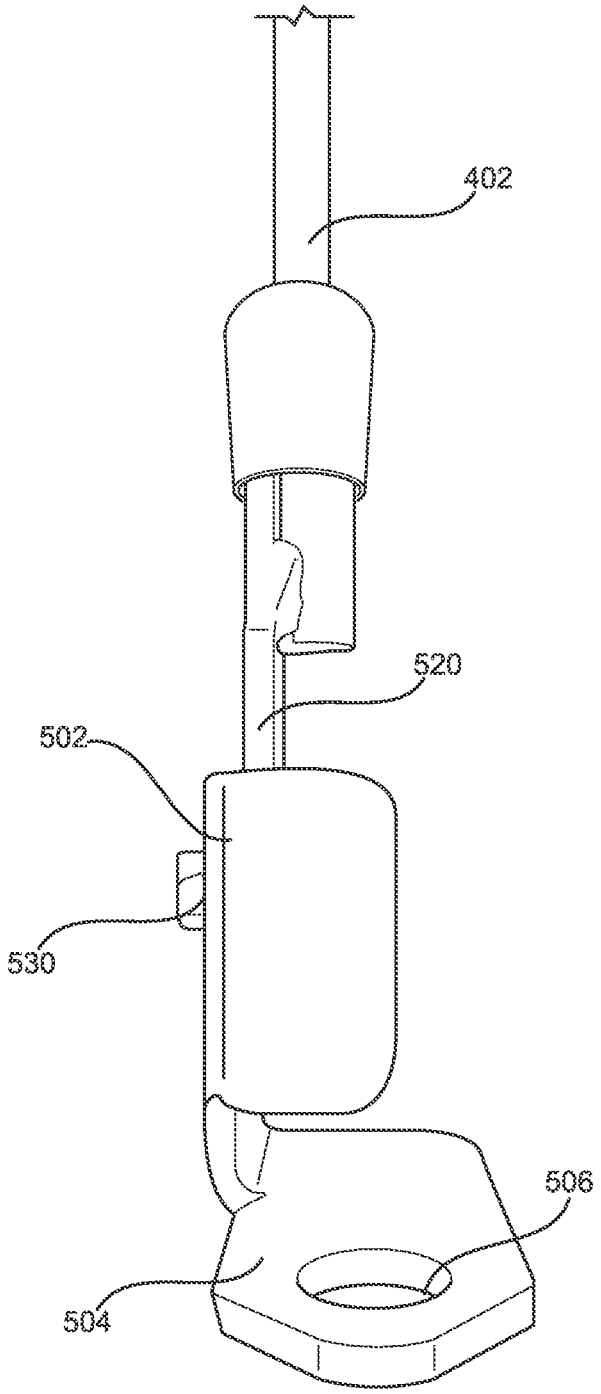
FIG. 15 is a left-side view of the base and indicator rod of the hydrant marker of the example fire hydrant marker system of FIG. 1 in the indicating position.
Figure 16:
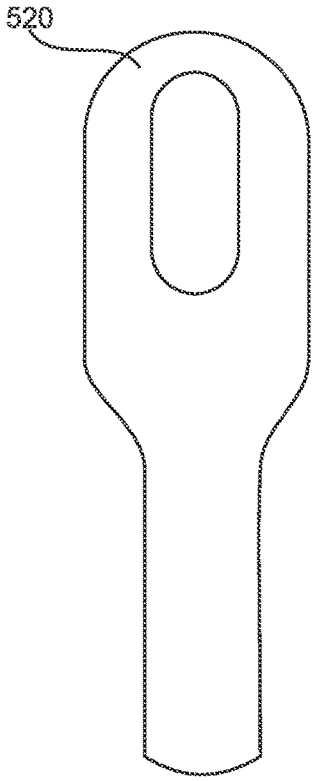
FIG. 16 is a front view of a base of the indicator rod of the example hydrant marker system of FIG. 1.

Finally, in the position shown in FIGS. 11-12, the hydrant marker 120 has been fully pivoted in the direction 540 to the folded position. Depending on the environment surrounding the hydrant 102, the free end 406 or other portion of the rod 402 of the hydrant marker 120 may contact and come to rest on the ground or other objects when pivoted to the folded position. In other instances, the hydrant marker 120 may pivot until the base 520 contacts the mounting piece 504 to come to rest in the folded position.

In some examples, the firefighter can hold the rod 402 of the hydrant marker 120 for the entire time as the hydrant marker 120 is pivoted from the indicating position to the folded position. In another example, the firefighter can release the rod 402 after lifting and starting the pivoting in the direction 540 to allow gravity to complete the movement of the hydrant marker 120 to the folded position. The hydrant marker 120 remains in the folded position without further input from the firefighter. This enhances the safety of the hydrant marker 120, since it will not unexpectedly or inadvertently move back to the indicating position.

To return the hydrant marker 120 from the folded position to the indicating position, the process described above is generally reversed. Specifically, the firefighter moves the hydrant marker 120 in a direction opposite the direction 540 to pivot the base 520 into the vertical position. At that point, the base 520 moves vertically (e.g., by gravity) so that the fastener 530 slides in the opening 522 to the indicating position.

In alternative embodiments, a fastener (not shown) is positionable through the opening 510 to fix the hydrant marker 120 in the indicating position. The fastener, such as a bolt with a nut, locks the base 520 of the hydrant marker 120 from being moved vertically on the fastener 530 to foreclose the hydrant marker 120 be pivoted to the folded position. This provides tamper resistance for the hydrant marker 120. The fastener can be removed, if desired, to allow for the hydrant marker 120 to be pivoted to the folded position.

Figure 23:
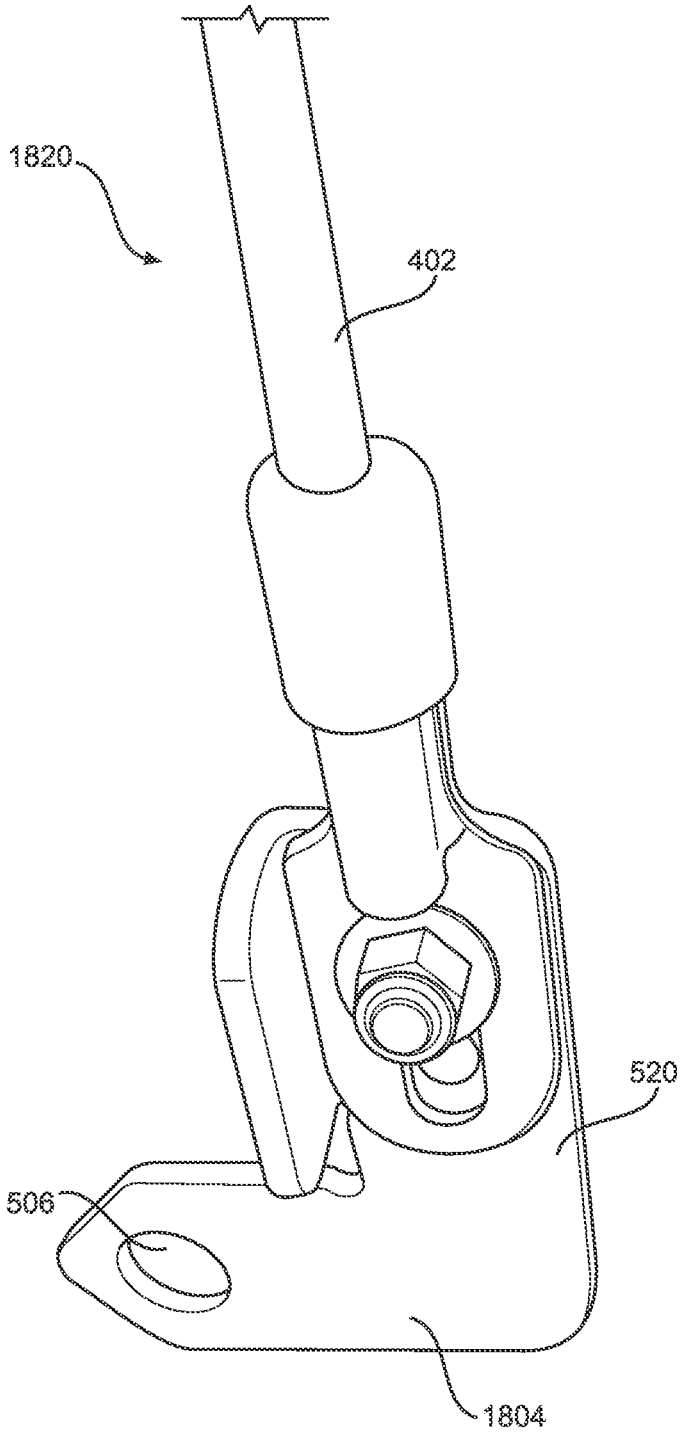
FIG. 23 is a perspective view of another embodiment of the example fire hydrant marker system in an indicating position.
Figure 24:
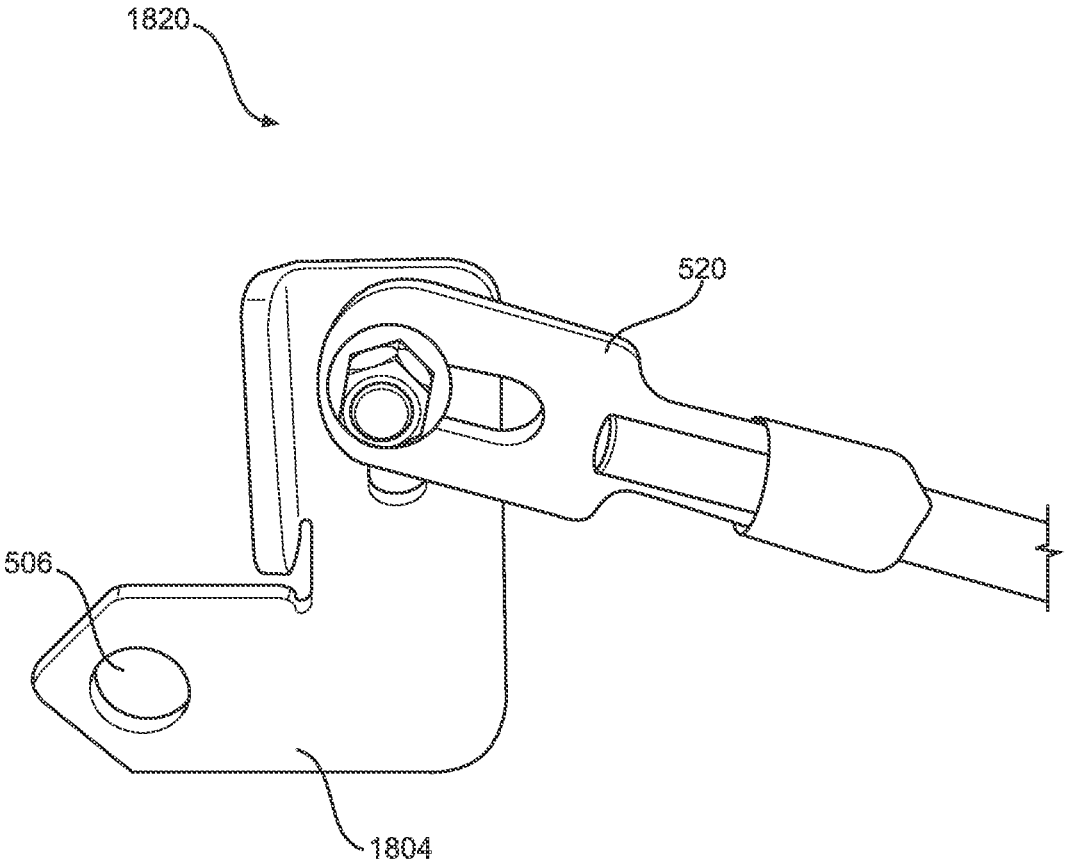
FIG. 24 is a perspective view on the example fire hydrant marker system of FIG. 23 in a folded position.

Referring now to FIGS. 23-24, an alternative embodiment of a hydrant marker 1820 is shown. The hydrant marker 1820 is configured similarly to that of the hydrant marker 120 described above.

However, a mounting piece 1804 of the hydrant marker 1820 is positioned generally parallel (rather than perpendicular) to the vertical member 508. In this configuration, the mounting piece 1804 is positionable on a fastener extending horizontally (rather than vertically) from the hydrant 102. In alternative configurations, the interface between the hydrant marker and the hydrant can be modified to accomplish the desired indicating and folded positions.

The various embodiments described above are provided by way of illustration only and should not be construed to be limiting in any way. Various modifications can be made to the embodiments described above without departing from the true spirit and scope of the disclosure.

What is claimed is:

1. A fire hydrant marker, comprising:
an indicator rod extending to a free end; and
a base comprising:
a mounting portion configured to be mounted to a fire hydrant; and
a vertical portion extending from the mounting portion, the vertical portion being configured to hold the indicator rod in an indicating position and allow the indicator rod to be pivoted from the indicating position to a folded position, wherein the indicator rod remains in the folded position.

2. The fire hydrant marker of claim 1, wherein the indicator rod is arranged in a substantially horizontal position when placed into the folded position.

3. The fire hydrant marker of claim 1, wherein the indicator rod is arranged in a substantially vertical position when placed into the indicating position.

4. The fire hydrant marker of claim 1, wherein the base includes a tamper proof device to prevent the indicator rod from being placed into the folded position.

5. The fire hydrant marker of claim 1, wherein the indicator rod is slidably connected to the vertical portion.

6. The fire hydrant marker of claim 1, wherein the base further comprises a stopping member, wherein the stopping member contacts the indicator rod when the indicator rod is placed into the indicating position and prevents the indicating rod from being pivoted into the folded position.

7. The fire hydrant marker of claim 6, wherein the stopping member is located perpendicularly relative to the vertical portion.

8. The fire hydrant marker of claim 1, wherein the indicator rod includes a mounting plate at a mounting end that is arranged opposite the free end.

9. The fire hydrant marker of claim 8, wherein the mounting plate includes an elongated opening.

10. The fire hydrant marker of claim 9, wherein a fastener extends through an opening in the vertical portion and through the elongated opening.

11. A fire hydrant assembly comprising:
a fire hydrant; and
a fire hydrant marker comprising:
an indicator rod extending to a free end; and
a base comprising:
a mounting portion configured to be mounted to the fire hydrant; and
a vertical portion extending from the mounting portion, the vertical portion being configured to hold the indicator rod in an indicating position and allow the indicator rod to be pivoted from the indicating position to a folded position, wherein the indicator rod remains in the folded position.

12. The fire hydrant assembly of claim 11, wherein the mounting portion lies flush with a flange on the fire hydrant when mounted thereto.

13. The fire hydrant assembly, of claim 11, wherein the fire hydrant comprises a stem nut, and wherein when placed in the folded position, the fire hydrant marker provides enhanced user access to the stem nut.

14. The fire hydrant assembly of claim 11, wherein the fire hydrant marker is configured to be adjusted between the folded position and the indicating position without the use of tools.

15. The fire hydrant assembly of claim 11, wherein the indicator rod is slidably connected to the base, wherein the indicator rod must be slid before it is allowed to be pivoted from the indicating position to the folded position.

16. The fire hydrant assembly of claim 11, wherein the base includes a tamper proof device to prevent the indicator rod from being pivoted into the folded position.

17. The fire hydrant assembly of claim 11, wherein the mounting portion is coplanar with the vertical portion.

18. The fire hydrant assembly of claim 11, wherein the mounting portion is perpendicular to the vertical portion.

19. The fire hydrant assembly of claim 11, wherein the fire hydrant marker further comprises a stopping member, wherein the stopping member is perpendicular to the vertical portion.

20. The fire hydrant assembly of claim 19, wherein the stopping member contacts the indicator rod when the indicator rod is placed into the indicating position and prevents the indicating rod from being pivoted into the folded position.

* * * * *